United States Patent [19]

Sexstone

[11] 4,016,830

[45] Apr. 12, 1977

[54] APPARATUS FOR DISPENSING SPACED DEPOSITS OF PARTICULATE MATERIAL

[75] Inventor: John H. Sexstone, Anchorage, Ky.

[73] Assignee: Brown & Williamson Tobacco Corporation, Louisville, Ky.

[22] Filed: July 16, 1975

[21] Appl. No.: 596,374

[52] U.S. Cl. ..... 118/406; 93/1 C

[51] Int. Cl.[2] ..... B05C 19/00

[58] Field of Search ..... 118/406; 222/370, 367; 93/1 C, 77 FT; 101/119, 120

[56] References Cited

UNITED STATES PATENTS

| | | | |
|---|---|---|---|
| 1,815,321 | 7/1931 | Martin | 222/367 X |
| 3,091,216 | 5/1963 | Scotti | 118/406 |
| 3,312,151 | 4/1967 | Molins | 93/1 C |
| 3,570,557 | 3/1971 | Molins | 222/367 X |
| 3,613,635 | 10/1971 | Brehm | 118/406 |

*Primary Examiner*—John P. McIntosh
*Attorney, Agent, or Firm*—William J. Mason

[57] ABSTRACT

An apparatus having a rotating material transport member with a plurality of openings through a rim on the transport member that divides particulate material supplied to the interior of the member into a plurality of metered amounts by placing the material within the openings. The particulate material flows into the openings from a material supply within the transport member for a limited rotational arc that determines the amount of material within the openings. The metered particulate material is prevented from flowing out of the openings by an external member covering the openings on a limited exterior portion of the transport member. The openings eventually rotate past the extremities of the external member and the material within the openings then falls out of the openings in spaced deposits of controlled metered amounts.

23 Claims, 9 Drawing Figures

APPARATUS FOR DISPENSING SPACED DEPOSITS OF PARTICULATE MATERIAL

The present invention relates to an apparatus for dispensing metered amounts of particulate material in spaced deposits. More particularly, the invention relates to an apparatus for dispensing metered amount of a particulate additive into a continuous moving length of tobacco smoke filter material.

The apparatus of the invention is particularly well suited to the dispensing of tobacco smoke filter additive alleviating several difficulties present in prior art devices.

Typical of such prior art devices is U.S. Pat. No. 3,844,200 to Sexstone where a rotating member having cavities on its peripheral surface is loaded with a granular tobacco smoke filter additive at the top of the device. The additive is confined in the cavities by an external member that is in contact with the peripheral surface of the rotating member. U.S. Pat. No. 3,550,508 is somewhat similar in operation.

One of the major disadvantages of such devices that is alleviated by the present invention is the generation of additive fines and their uncontrolled distribution to the filter material receiving the additive. Prolonged rubbing contact of the granular material within the prior art cavities on the external member generates fine particles of significantly smaller size than the bulk of the particulate or granular additive. The larger size particles are retained within the cavities until each cavity is exposed at the extremity of the external member thereby yielding discrete amounts of particulate material in accurately spaced deposits on whatever means receives the material, i.e., the continuous length of filter material. Fine particles, however, are more difficult to control since they may, if their particle size is small enough, pass to the area between the cavities by way of the clearance between the rotating member and the external member. The passage of fine particulate material between the openings results in there being particulate material dispensed to the filter material between the spaced deposits. In applications where the particulate material is an additive in a tobacco smoke filter, the additive may ultimately end up at a location between spaced deposits where the continuous filter rod is cut to form each individual tobacco smoke filter. The presence of such an additive at the end of the filter is extremely detrimental since such additives generally have a highly objectional taste and at that location the probability of the consumer tasting the additive is high. Therefore, a dispensing apparatus should dispense additive only to the desired locations and not produce fines that cannot be accurately dispensed.

Other prior art devices dispense particulate materials to continuous filter material using a reciprocating transport member having an opening therethrough. U.S. Pat. No. 3,837,264 to Sexstone is typical of such a device where particulate material is fed to an opening and the opening moved linearly to the dispensing location. Such devices do not produce significant amounts of fine particles and if properly operated there is no propensity of such a device to place granular material at locations other than that preselected. The major disadvantage of such devices is the speed of operation is limited due to the nature of the transport member. In such devices the openings from which the additive is dispensed are stationary in relation to the movement of the filter material. Since it takes a finite amount of time for the additive to empty from the opening and fall onto the moving filter material, the filter material must move slowly enough to protect the deposit from being elongated by the movement of the material. As a result of this limitation apparatus of this type must operate at less than commercially desired rates. The use of the rotating transport member of the present invention allows the speed of the moving filter material to be matched by the moving transport member thereby reducing or eliminating relative motion therebetween. The reduction or elimination of relative motion negates the effect of the finite time involved in the material falling from the transport member to the moving filter material. This results in the deposits of granular material being placed in discrete deposits with a minimum amount of deposit elongation.

An additional problem with all the prior art devices is the non-uniformity of the metered amounts dispensed. The cited references disclose only simple hopper-like material supply means that may vary the bulk density of particulate materials filling the openings or cavities dispensing the material depending on the packing or height of the material within the hopper. While the present invention relies on gravity feed as do such hopper-like devices, the present invention has demonstrated a uniformity in the amounts dispensed superior to the prior art devices.

Accordingly, it is the primary object of this invention to dispense uniformly portioned amounts of particulate material in discrete deposits.

It is a further object of the invention to provide an apparatus useful in the manufacture of tobacco smoke filters that can dispense separate metered amounts of a tobacco smoke treating additive on a moving substrate.

Another object of the invention is to provide an apparatus for dispensing separate metered amounts of particulate material onto a substrate moving at relatively high speeds.

Still another object of the invention is to provide a dispensing apparatus that minimizes the formation of fine particles by the attrition or fracture of granular materials dispensed in metered amounts at relatively high speeds on a moving substrate.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention, as embodied and broadly described herein, the invention comprises an apparatus for dispensing metered amounts of particulate material in spaced deposits utilizing a rotatable transport member having a plurality of openings therethrough. The member transports particulate material within openings that are in flow communication with the interior and exterior of the transport member, the openings receiving and dispensing particulate material placed therein. A means for supplying particulate material to the interior of the transport member is provided. The supply means provides access for the particulate material to the openings within the interior of the transport member. Means on the exterior of the transport member controls the flow of the material from the openings in the transport member.

Preferably the apparatus would dispense metered amounts of a tobacco smoke filter additive in spaced deposits onto a continuous length of tobacco smoke filter material. In such a preferred embodiment, the operative portions of the dispensing apparatus would be similar to that summarized above but the device would include an additional filter material handling element. Means for moving a continuous length of filter material would be provided in such an embodiment. The filter material is moved at a location adjacent the transport where it will receive the particulate additive issuing from the openings. The member is moved at a velocity in direct relation to the speed of rotation of the transport member.

BRIEF DESCRIPTION OF THE DRAWINGS

The invention consists in the novel parts, constructions, arrangements, combinations and improvements shown and described. The accompanying drawings, which are incorporated and constitute a part of this specification, illustrate one embodiment of the invention and together with the description serve to explain the principles of the invention.

Of the drawings.

DESCRIPTION OF THE PREFERRED EMBODIMENTS

Reference will now be made in detail to the present preferred embodiment of the invention, an example of which is illustrated in the accompanying drawings.

Figure 1:
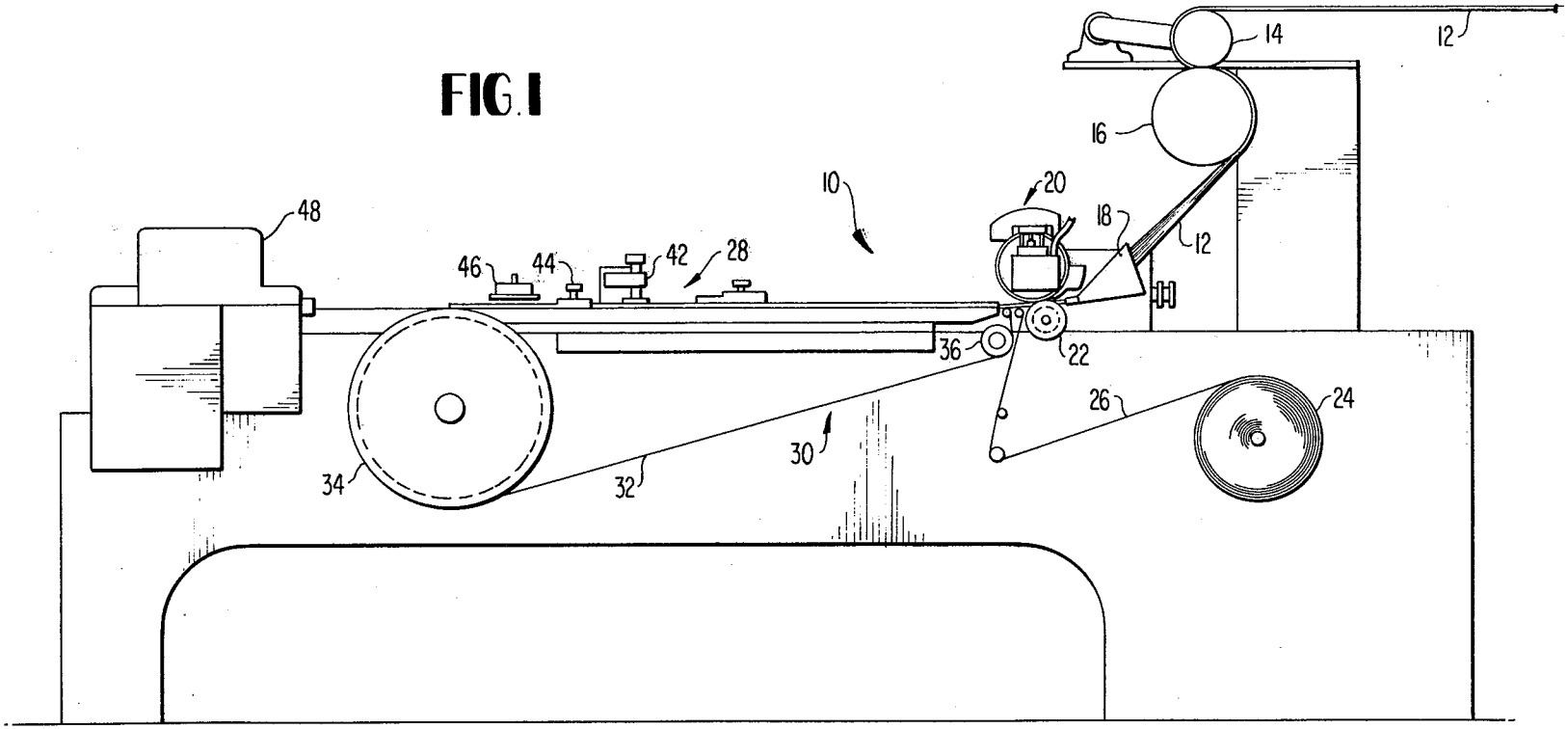
FIG. 1 is an elevational view of a filter rod-forming machine incorporating the teachings of this invention.

Referring now to FIG. 1 where the preferred application of the invention is disclosed as an apparatus 10 for dispensing metered amounts of a particulate material onto a continuous length of tobacco smoke filter material 12. In such an apparatus, the filter material may be a fiberous cellulose acetate tow, paper, bulked yarn or any other filamentary filter material well known to the art. The particulate granular material contemplated for the application of the invention depicted would be a tobacco smoke filter additive as for example, particulate charcoal, silica gel, volcanic salts, ion exchange resins, clays and the like. The particulate additive contemplated in disclosure of this invention is an ion exchange resin "Duolite" disclosed in U.S. Pat. No. 3,716,500.

The continuous filter material 12 is supplied from a conventional storage bail (not shown) to the apparatus 10 and may be subjected to the application of a plasticizer. The plasticizer normally used for a cellulose acetate filter material is triacetin and it may be applied prior to the delivery of filamentary material as depicted. In the embodiment shown in FIG. 1, the tow 12 is passed between the delivery roll 14 and roll 16. The tow 12 is then passed to shaping means that form the tow into a continuous structure disposed to receive the particulate material from the dispensing means.

Figure 7:
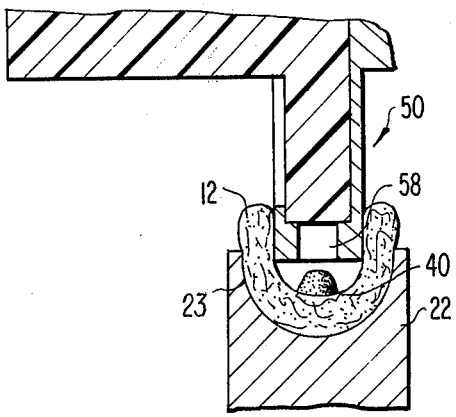
FIG. 7 is a fragmented cross-sectional view taken along the line 7—7 of FIG. 4 showing shaped filter material beneath the transport member with a deposit of particulate material therein.
Figure 8:
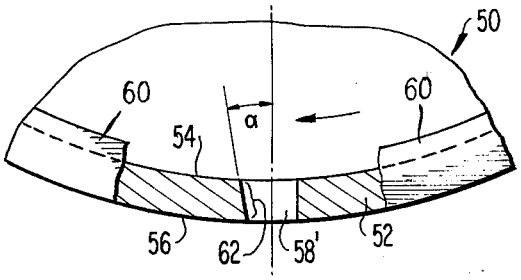
FIG. 8 is an enlarged cross-sectional view of the transport means showing in detail a preferred configuration of the openings.

Preferably the continuous length of filter material, the tow 12, is moved past the transport member portion of the dispensing means at a velocity in direct relation to the speed of rotation of the transport member. The shaping means disclosed includes a trumpet 18 receiving the tow 12 in a spread or expanded condition. The spreading or expanding of the two can be carried out by means well known in the art. The preferred shape of the tow 12 at a point adjacent the dispensing means is illustrated in FIG. 7 where a cross-section of the tow 12 depicts a U-shaped member into which the granular material can be dispensed. The present invention may utilize any means of forming the tow into the U-shaped cross-section with one preferred means shown in FIG. 4 of U.S. Pat. No. 3,844,200 where a ribbed member within the trumpet depresses the central portion of the tow to form the desired U-shaped cross-section.

Figure 3:
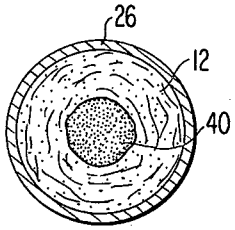
FIG. 3 is a cross-sectional view taken along the line 3—3 of FIG. 2.
Figure 2:
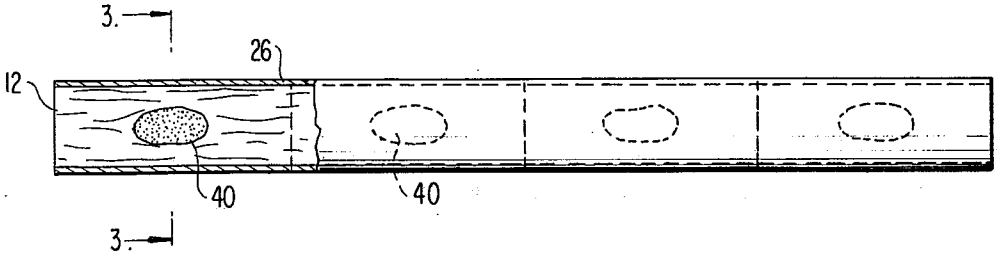
FIG. 2 is a length of filter rod formed by the machine of FIG. 1 with certain parts broken away and removed showing pockets at spaced intervals in the filter material containing a selected additive in particulate or granular form.

As depicted in FIG. 1, the U-shaped tow is then continuously passed adjacent the dispensing means 20. The dispensing means 20 may include a stabilizing member 22 depicted in FIGS. 1, 4 and 5 for the purpose of stabilizing the shape of the U-shaped tow 12 while the granular material is delivered to the tow. Subsequent to the delivery of the granular material to the tow, it is partially wrapped with a continuous web of paper or the like from supply roll 24. The tow 12, now at least partially enclosed by wrapper 26, is driven into the final shaping means, the graviture 28, by the drive means 30 comprising an endless drive belt 32, drive roll 34 and rolls 36 and 38. In the graviture the partially enclosed U-shaped tow is given its final shape by sequentially forming the tow 12 and the wrapper 26 into the cylindrical form depicted in FIGS. 2 and 3. The essentially cylindrical tow 12 with the spaced deposits of granular material 40 together with the wrapper 26 is driven through the apparatus with one marginal edge of the wrapper exposed to the glue applicator 42. Thereafter, folder 44 engages the edge and folds it into contact with the other edge with the applied glue in between for purposes of sealing the wrapper about the tow. The wrapped tow is fed through the heater 46 and subsequently to the cut-off station 48 where the continuous member is cut into a plurality of individual tobacco smoke filters as depicted in FIG. 2. The cutting of the continuous member is synchronized with the dispensing means so the cuts are placed between the shaped deposits of granular material.

In accordance with the invention, an apparatus for dispensing metered amounts of granular material in spaced deposits is disclosed. As previously set forth, the invention is particularly suited to the manufacture of tobacco smoke filters containing a particulate additive, however, the disclosure of the invention will indicate the utility of the invention as a dispensing means in general and the relation of the invention to tobacco smoke filters is but one example of a use for the invention.

In accordance with the invention, the dispensing means includes a rotatable transport member for transporting discrete amounts of particulate material. As depicted herein and best seen in FIGS. 4 and 9, the transport member 50 is basically circular and rotates about a central axis of rotation. Preferably the rotation is synchronous with the movement of receiving means accepting the particulate material being dispensed and cutting means if the receiving means is to be reduced from a continuous member to a plurality of individual components. The transport member is rotationally driven by any conventional means and no specific teaching as to the drive for the transport member would be needed for those skilled in the art.

The transport member necessarily includes a plurality of openings in flow communication with the interior and exterior of the transport member. The openings receive and dispense particulate material placed therein. As here embodied and best seen in FIGS. 4 and 9, the tranport member 50 is circular having a cylindrical rim 52 attached thereto. The axis of symmetry for the rim 52 is coexistent with the axis of rotation of the transport member 50. The rim 52 has an inner surface 54 and an outer surface 56. These surfaces are preferably smooth since both provide sealing surfaces for means that control the flow of the particulate material. As depicted in FIGS. 4 through 9, the openings 58 pass through the rim 50 connecting the inner and outer surfaces, 54 and 56 respectively.

Figure 5:
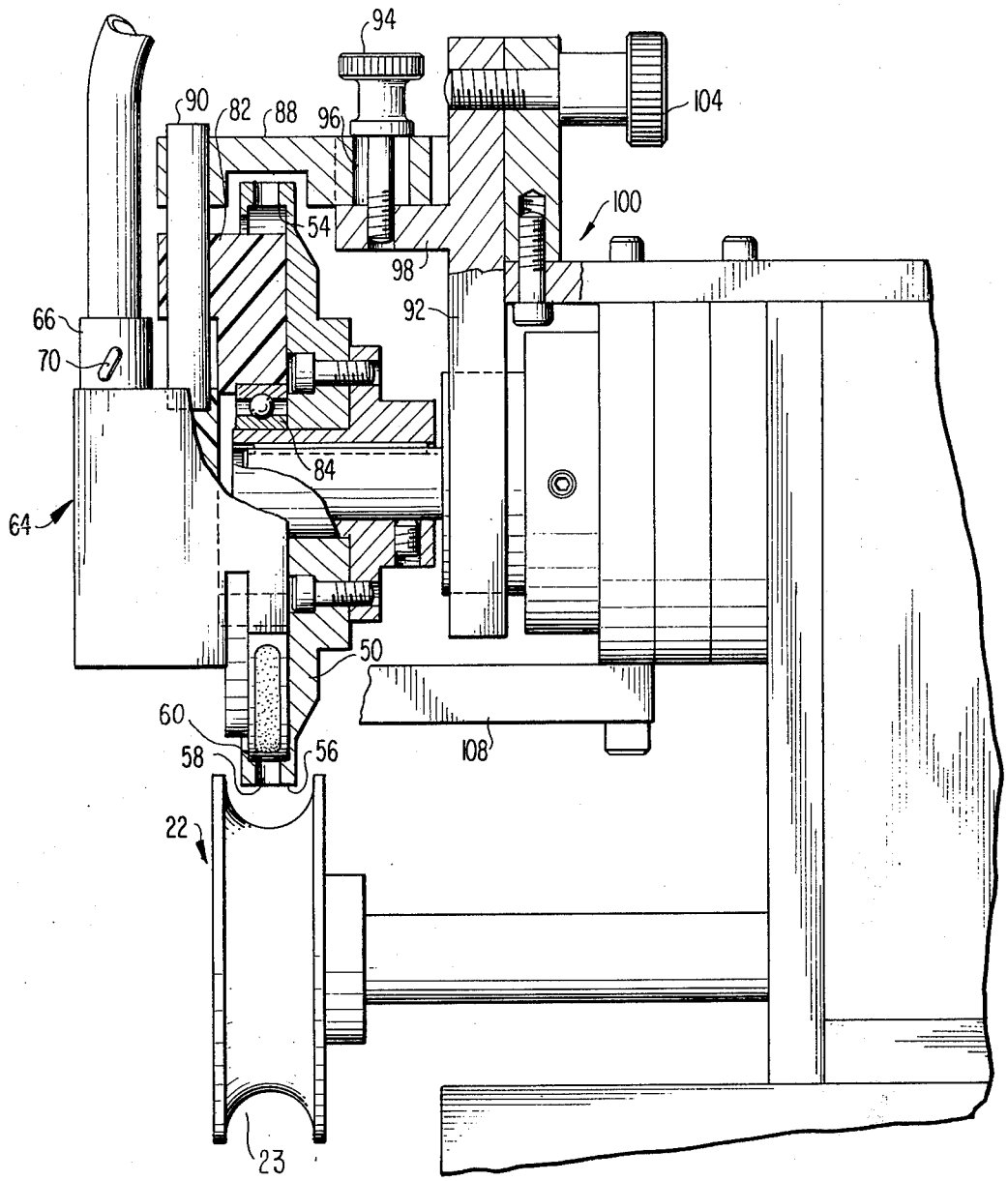
FIG. 5 is a fragmented partial cross-sectional view of one embodiment of the invention depicting the assembled relationship of the supply means, the transport means and means to adjust the flow of particulate material into the interior of the transport member.
Figure 6:
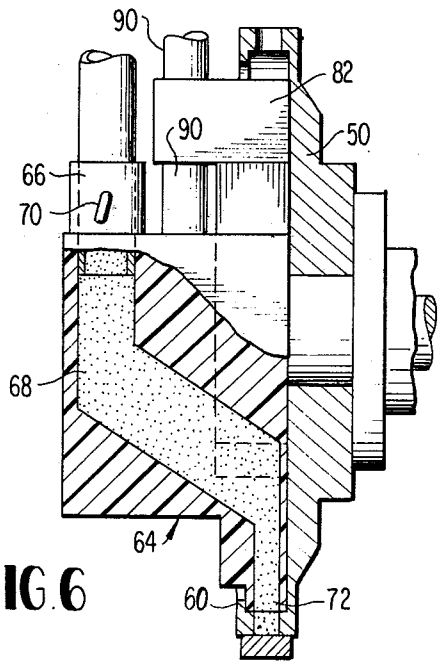
FIG. 6 is a fragmented partial cross-sectional view of one embodiment of the invention showing the cooperation of the supply means and the transport member.

Preferably the rim 52 includes a vertical flange 60 on the outer portion of the rim. The flange 60 defines the outer extremity of the inner surface 54 of the rim. As depicted in FIGS. 5, 6, and 7, the flange 60 provides locating support for means placed within the transport member 50 that are in contact with the inner surface 54 of the rim 52.

Figure 9:
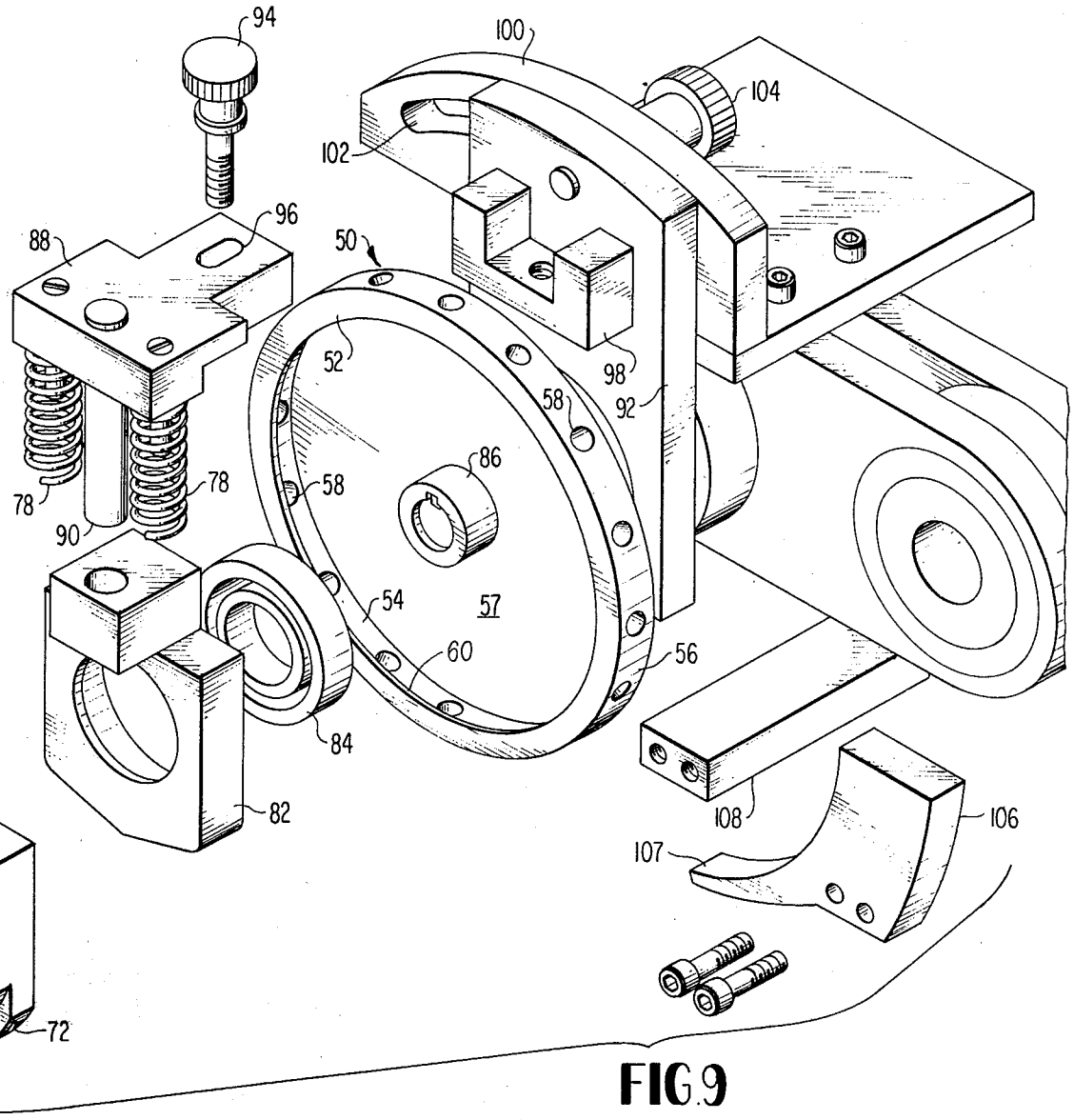
FIG. 9 is an exploded prospective view of the separated elements of one embodiment of the invention.

Preferably, the openings in the transport member are substantially circular as depicted in FIG. 9. However, the shape of the openings is not critical to the operation of the invention. The openings may be tapered to be divergent from either the inner or outer surface (54 and 56 respectively) or they may be of non-circular configuration. The opening should have sufficient volume to contain sufficient amounts of particulate material to be deposited in the receiving means.

Where the invention is utilized for the manufacture of tobacco smoke filters containing a plurality of spaced deposits of a smoke treating additive, a particular configuration of opening 58 is particularly preferred. The preferred opening form is depicted in cross-section in FIG. 8 where the openings 58' are substantially circular but have a tapered portion displaced from 5° to 10° the cylindrical axis of the opening. The conical portion 62 is divergent from the outer surface 56 with the angle of the tapered portion indicated in FIG. 8 as $\alpha$. As indicated by the arrow in FIG. 8, the transport member rotates such that the tapered portion 62 precedes the remainder of the opening 58'. Therefore, when the opening 58' is in contact with control means on the inner surface 54 of the rim 52, it is the conical portion 62 tht first receives the particulate material. In the manufacture of tobacco smoke filters having spaced deposits of a tobacco smoke additive, it is preferred that the openings be substantially circular in cross-section with a diameter of approximately 0.25 inches. Openings of such a size and configuration have sufficient volume that they can transport and dispense amounts of such an additive in the amounts desired.

Figure 4:
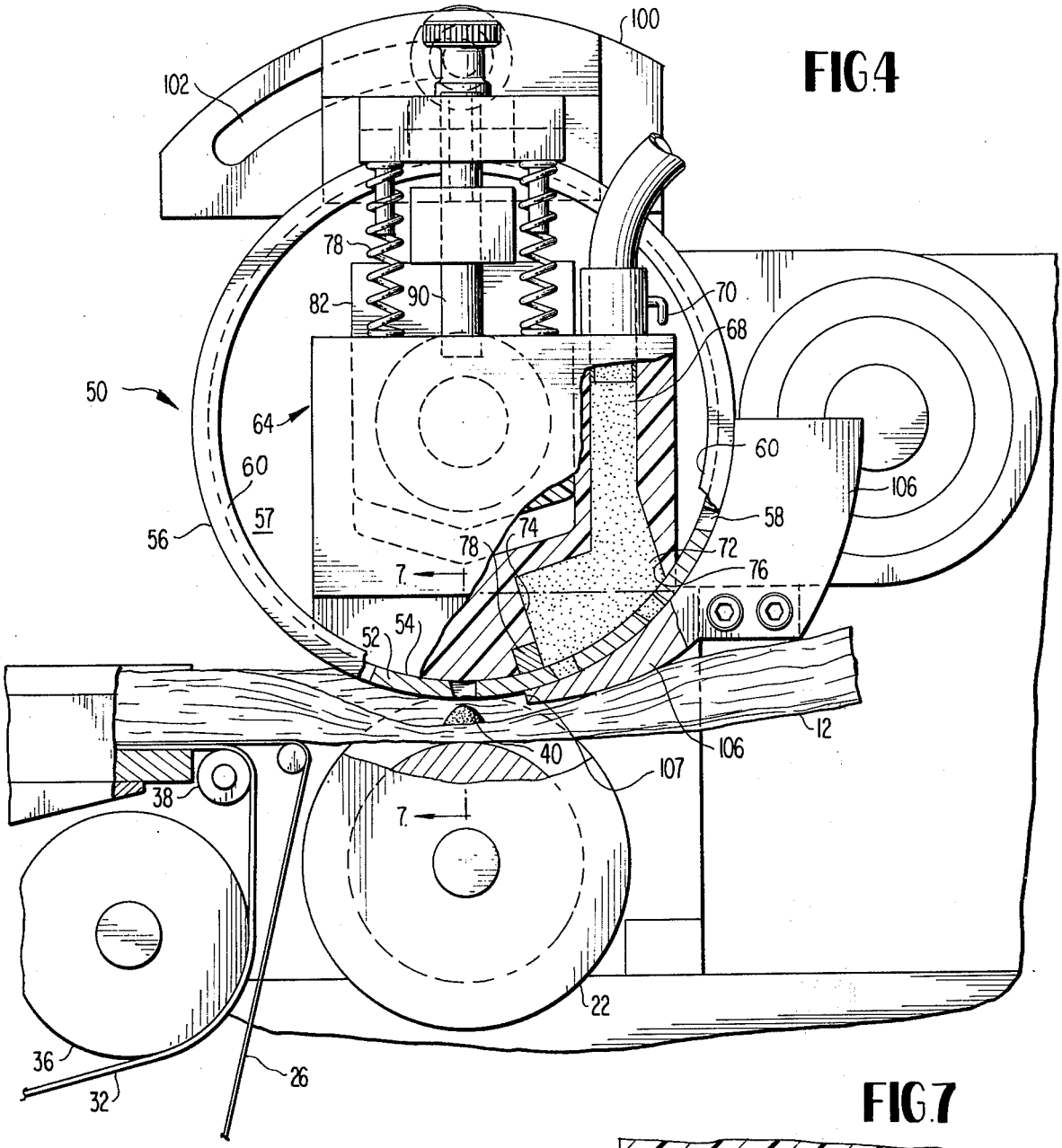
FIG. 4 is a fragmented partial cross-sectional view depicting one embodiment of the invention.

As previously disclosed, it is preferred that where the invention is used to dispense an additive into a continuous moving substrate of filter material, some stabilizing means be provided to support the substrate in the appropriate shape. As seen in FIGS. 4 and 5 and best depicted in FIG. 7, a stabilizing means is provided adjacent the transport member for stabilizing the filter material while the material is shaped to receive the particulate additive. As here embodied, the stabilizing means comprises a circular member 22 having a concave semicircular circumferential groove 23. The member 22 is disposed to rotate at a speed in relation to that of the filter material (tow 12) and preferably synchronous with the transport member 50. The function of the stabilizing means is to support the filter material in the particular shape it is given for the receipt of the particulate material. As here embodied, the circular member 22 has a semicircular groove disposed to support the tow 12 in its U-shaped cross-section.

In accordance with the invention means for supplying particulate material to the interior of the transport member are provided. The supply means provides access for the particulate material to the openings within the interior of the transport member. As here embodied and best seen in FIGS. 4, 5, and 9, the supply means comprises a housing 64 having an inlet 66 through which particulate material is introduced to an interior passage 68 that ultimately introduces the particulate material to the openings 58. Preferably, the inlet 66 includes means for terminating the flow of particulate material through the supply means. As depicted in FIGS. 4, 5, 6, and 9, a valve 70 is provided in the inlet. The structure of the valve is not critical and it functions only to shut off the flow of particulate material to the housing 64 and its associated internal passage 68. The flow of particulate material through the supply means terminates at the interface of the housing 64 and the transport member 50. At that surface, it is preferred that interior control means be provided that would confine access of the particulate material to a limited number of openings within the interior of the transport member.

As here embodied and depicted in FIGS. 4, 6, and 9, the interior control means comprises a portion of the supply means. The figures depict a chamber 72 at one extremity of the supply means that is an integral part of the housing 64. The chamber 72 has particulate material supplied thereto, preferably by the action of gravity through inlet 66. The chamber 72 is formed to provide sealing contact with the inner surface 54 of the transport member 50 and thereby limit access of the openings 58 to the particulate material only when the openings are within the confines of the chamber 72.

In the embodiment shown and best seen in FIGS. 5 and 6, the chamber fits within the interior of the transport member between the flange 60 and the vertical interior portion 57 of the transport member 50. The chamber is comprised of a pair of spaced wall means, here embodied in FIG. 4 as trailing wall 74 and leading wall 76. As the transport member rotates in sliding contact with the wall means the passage of an opening 58 past the leading wall 76 allows particulate material to flow into the opening. The passage of the openings 58 past the trailing wall 74 terminates flow of the particulate material into the openings 58.

Therefore, one means of preselecting the amount of particulate material placed within the openings 58 and thereby dispensed is to preselect the rotational arc of the transport member to be within the confines of the chamber 72. The wall means being spaced apart permit flow of particulate material only within the preselected arc described by the wall means. Preferably, the trailing wall 74 would include a metallic insert such as depicted in FIG. 4 as 78 that would resist abrasion at the trailing wall 74 where the particulate material would be sheared during the closure of the openings 58.

As here embodied the interior of the transport member 50 has a curved inner surface 54 through which the openings pass. The inner surface 54 and the exterior extremity of the chamber 72 both have constant and substantially equal radii of curvature. As depicted in FIG. 9, the extremity of the chamber 72 has an arcuate form that fits the inner surface 54 and preferably, the chamber is forced into contact with the inner surface 54. As depicted in FIGS. 4 and 9, springs 78 are provided between a rigid member and the housing 64 of which the chamber 72 is an integral part to force the chamber into sealing contact with the inner surface of the transport member. The particular embodiment shown also provides a convenient means of removing and replacing the supply means within the transport member. The flange 60 prevents the housing 64 means from being removed by simple axial movement. By compressing the springs, the housing 64 and the chamber 72 can be moved above the flange 60 and thereafter removed axially.

As previously described, the flow of particulate material into the openings 58 is effected by limits placed on the exposure of the openings to the chamber. While this exposure may be limited by the extent of the rotational arc described by the leading and trailing walls the speed of rotation of the transport member 50 also effects the exposure and hence the amount of particulate material within the openings.

Another means of controlling the flow of particulate material into the openings is by changing the location of the chamber 72 within the transport member. Since the flow of particulate material is preferably induced by gravity the flow is sensitive to changes in the configuration of the supply means that direct the flow in any other direction than straight down. Preferably the location of the chamber 72 is changed by rotating the chamber about the axis of rotation of the transport member 50. In such a preferred embodiment, the housing 64 would be mounted in a manner enabling rotation of the housing about the axis of rotation of the transport member 50.

FIGS. 4, 5, and 9 depict a preferred embodiment of the invention that allows the movement of the supply means and the associated internal control means (here embodied as chamber 72) about the axis of rotation of the transport member. The housing 64 has a slot 80 disposed to fit about an adaptive member 82, and as best depicted by FIG. 4, the housing 80 can move in a generally vertical direction while engaged on the adaptive member 82. While the adpative member 82 is shown in a vertical position, it is mounted on a bearing 84 which is, in turn, mounted on a shaft 86 that is common to and concentric with the transport member 50 thereby allowing rotation of the adaptive member. Therefore, the rotation of the transport member 50 can occur while the adaptive member 82 maintains the housing 64 and hence, the chamber 72 is in a fixed position in sealing contact with the inner surface 54 of the rim 52 of the transport member 50. Since the rotation of the transport member would tend to rotate the adaptive member 82, locking means are provided to affix the adaptive member in a preselected position within the transport member.

As here embodied and depicted in FIGS. 4, 5, and 9, the locking means comprises the bridge member 88 affixed to the adaptive member 82 by pin 90 which passes through the adaptive member and also into the housing 64 thereby affixing the housing to the adaptive member. As previously disclosed, the springs 78 force the chamber 72 into sealing contact with the inner surface 54 of the rim 52. As here embodied, the springs 78 are disposed between the bridge member 88 and the housing 64. The bridge member 88 is in turn affixed to the rotatable support means here embodied as rotatable support 92 rotationally mounted on an axis of rotation common to the transport member 50. The bridge member 88 is affixed to the rotatable support 92 by means of a fastener 94 that passes through an elongated slot 96 within the bridge member 88 allowing limited axial adjustment of the bridge member 88 and the components affixed thereto. The portion of the bridge member 88 that is affixed to the rotatable support 92 is preferably contained within receiving means providing axial alignment to the bridge member. As here embodied, the bridge member 88 is affixed within a U-shaped receiving structure 98. The fit of the bridge member 88 within the structure 98 is disposed to allow limited axial movement while preventing any substantial rotation of the bridge member about the fastener 94. The rotatable support 92 is, in turn, adjustably secured to fixed bracket means here embodied and best seen in FIG. 4 as the fixed bracket 100. The fixed bracket 100 includes an arcuate slot 102 in which a fastener 104, affixed to the bridge rotatable support 92, is located. The rotatable support 92 is thereby limited in rotational movement by the extremities of the arcuate slot 102 which, in turn, limits the rotational movement of the chamber 72 within the transport member 50.

In the embodiment shown herein, there is provided a convenient and stable means for adjusting the flow of particulate material into the openings in the transport member. While the confines of the chamber 72, the size and configuration of the openings 58, the rotational speed of the transport member 50 and the position of the chamber 72 within the chamber primarily control the flow of particulate material into the openings. Another element of the invention controls the flow of particulate material out of the openings.

In accordance with the invention, exterior control means control the flow of particulate material from the openings by limiting external exposure of the openings. As here embodied and most clearly depicted in FIG. 4, the exterior control means comprises a member 106 in sealing contact with the outer surface 56 of the transport member 50 thereby preventing flow of the particulate material from the openings 58 until the openings have passed the extremity 107 of the member 106. The member 106 is constructed with a radius of curvature substantially equal to that of the outer surface 56 of the transport member 50 to provide a sealing contact with the transport member.

In a further preferred embodiment, the openings 58 in the transport member 50 would pass the confines of the chamber 72 terminating flow into the openings prior to the openings 58 passing the extremity 107 of the exterior control means where flow of the particulate material from the openings 58 initiates. In such a preferred embodiment, there would be no opportunity for unrestrained flow of the particulate material through the openings. As depicted in FIG. 9, the member 106 is affixed to a mount 108 which is rigidly affixed to the apparatus.

A preferred embodiment of the invention has been disclosed for a particular application, that of dispensing a particulate additive into a moving tow of filter material. The invention is not limited to the embodiment disclosed and has utility for the dispensing of particulate material into receiving means other than a moving substrate. One skilled in the art may make modifications and variations to the embodiment disclosed herein and remain within the scope of the invention as defined by the appended claims.

What is claimed is:

1. Apparatus for dispensing metered amounts of particulate material in spaced deposits comprising:

a. a rotatable transport member for transporting discrete amounts of said particulate material, said transport member being comprised of a vertically disposed cylindrical rim having a plurality of spaced openings therethrough to receive and dispense particulate material placed therein;

b. particulate material supply means comprised of a downwardly directed chamber engaging a portion of said cylindrical rim, said rim being exposed to the interior of said chamber allowing flow of said particulate material into said openings while said openings are in the confines of said chamber; and c. control means for rotatably positioning said chamber in relation to the interior of said cylindrical rim to selectively alter the flow of particulate material from said chamber into said openings.

2. The apparatus of claim 1, wherein said chamber has an arcuate extremity in contact with the interior surface of said cylindrical rim, said arcuate extremity having a radius of curvature substantially equal to the radius of curvature of said interior surface.

3. The apparatus of claim 1 where said chamber is comprised of a pair of spaced wall means, said wall means being spaced apart a predetermined rotational arc of said transport means, said chamber permitting flow of said additive into said openings when said openings are between said wall means.

4. The apparatus of claim 1 where said apparatus includes means for forcing said chamber into contact with said interior surface.

5. The apparatus of claim 1 where the location of said chamber is changed by rotating said chamber about the axis of rotation of said transport member.

6. The apparatus of claim 1 where said chamber is an integral part of said supply means and said apparatus includes: adapter means detachable affixed to said supply means, said adapter means being rotationally mounted on a member having the same axis of rotation as said transport member allowing said adapter means, with said supply means affixed thereto, to rotate about the axis of rotation of said transport member; locking means affixed to said adapter means selectively affixing said adapter means at a predetermined rotational position within said transport member, said predetermined position effecting the relation of said chamber to said transport member thereby selectively altering the flow of said additive into said openings.

7. The apparatus of claim 6 where said adapter means includes a bearing mounted on a shaft common to said transport member.

8. The apparatus of claim 6 including a rotatable support means allowing rotational movement of said adapter about the axis of rotation of said transport member; said locking means comprising a bridge member affixed to said adapter means, said supply means and said rotatable support means.

9. The apparatus of claim 8 including spring means between said bridge member and said supply means, said spring means forcing said chamber into contact with the interior of said transport member.

10. The apparatus of claim 8 including a fixed bracket means where said rotatable support means is mounted to rotate about an axis of rotation common to the axis of rotation of said transport means, said rotatable support means being adjustably secured to said bracket means to permit rotational adjustment of said support means about said axis.

11. The apparatus of claim 10 including fastening means on said support means where said bracket means includes an arcuate slot in which said fastening means are located, extremities of said arcuate slot determining extremities of movement of said fastening means thereby limiting rotational movement of said chamber within said transport member.

12. The apparatus of claim 1 where said openings are substantially circular in cross-section.

13. The apparatus of claim 1 where said openings are tapered.

14. The apparatus of claim 1 where said openings are divergent from said inner surface.

15. The apparatus of claim 1 where said openings are divergent from said outer surface.

16. The apparatus of claim 1 including means for receiving said particulate material.

17. The apparatus of claim 16 where said receiving means comprises a moving substrate.

18. Apparatus for dispensing metered amounts of particulate tobacco smoke filter additive in spaced deposits into a continuous length of tobacco smoke filter material comprising:

a. a rotatable transport member for transporting discrete amounts of said particulate material, said transport member being comprised of a vertically disposed cylindrical rim having a plurality of spaced openings therethrough to receive and dispense particulate material placed therein;

b. particulate material supply means comprised of a downwardly directed chamber engaging a portion of said cylindrical rim, said rim being exposed to the interior of said chamber allowing flow of said particulate material into said openings while said openings are in the confines of said chamber;

c. control means for rotatably positioning said chamber in relation to the interior of said cylindrical rim to selectively alter the flow of particulate material from said chamber into said openings; and d. means for moving a continuous length of filter material adjacent said cylindrical rim at a velocity in direct relation to the speed of rotation of said cylindrical rim, said filter material being positioned to receive said additive from said openings.

19. The apparatus of claim 18 including means adjacent said transport member for stabilizing said filter material while said material is shaped to receive said addition.

20. The apparatus of claim 18 where said stabilizing means comprises a rotating circular member having a concave semicircular circumferential groove therein, said groove disposed to stablize said filter material therein.

21. The apparatus of claim 18 where said openings have a tapered portion displaced 5° to 10° from the cylindrical axis of said opening, said portion being divergent from said outer surface and at a position on said opening whereby said portion precedes the remainder of said opening into said interior control means.

22. The apparatus of claim 21 where said openings are substantially circular in cross-section.

23. The apparatus of claim 22 wherein said openings have a diameter of approximately 0.25 inch.

* * * * *